US007682271B2

(12) United States Patent
Rager

(10) Patent No.: US 7,682,271 B2
(45) Date of Patent: Mar. 23, 2010

(54) ARROWHEAD ASSEMBLY

(75) Inventor: Christopher A. Rager, Bozeman, MT (US)

(73) Assignee: Bear Archery, Inc., Evansville, IN (US)

( * ) Notice: Subject to any disclaimer, the term of this patent is extended or adjusted under 35 U.S.C. 154(b) by 491 days.

(21) Appl. No.: 11/496,737

(22) Filed: Jul. 31, 2006

(65) Prior Publication Data

US 2007/0037640 A1 Feb. 15, 2007

Related U.S. Application Data

(60) Provisional application No. 60/704,813, filed on Aug. 1, 2005, provisional application No. 60/755,204, filed on Dec. 30, 2005.

(51) Int. Cl.
*F42B 6/08* (2006.01)

(52) U.S. Cl. ..... 473/583; 473/584

(58) Field of Classification Search ..... 473/578, 473/583, 584
See application file for complete search history.

(56) References Cited

U.S. PATENT DOCUMENTS

| | | | | |
|---|---|---|---|---|
| 2,940,758 | A | 6/1960 | Richter | |
| 3,138,383 | A * | 6/1964 | McKinzie | 473/583 |
| 3,868,114 | A * | 2/1975 | Groner | 473/582 |
| 4,341,391 | A | 7/1982 | Anderson | |
| 4,410,184 | A | 10/1983 | Anderson | |
| 4,579,348 | A | 4/1986 | Jones | |
| 5,145,186 | A | 9/1992 | Maleski | |
| 5,494,298 | A | 2/1996 | Maleski | |
| 5,496,043 | A | 3/1996 | Ester | |
| 5,636,846 | A | 6/1997 | Tinsley | |
| 5,803,844 | A | 9/1998 | Anderson | |
| 5,803,845 | A | 9/1998 | Anderson | |
| 5,820,498 | A | 10/1998 | Maleski | |
| 6,045,468 | A | 4/2000 | Tinsley et al. | |
| 6,217,467 | B1 * | 4/2001 | Maleski | 473/583 |
| 6,290,903 | B1 | 9/2001 | Grace, Jr. et al. | |
| 6,322,464 | B1 * | 11/2001 | Sestak | 473/583 |
| 6,739,992 | B2 * | 5/2004 | Kummerle | 473/582 |
| 6,921,348 | B1 | 7/2005 | Johnson | |

OTHER PUBLICATIONS

WASP Archery, Fixed Blade Broadheads, http://wasparchery.com/broadheads_fixed.html, 2 pages, printed Oct. 31, 2006.
WASP Archery, Mechanical Broadheads, http://www.wasparchery.com/broadheads_mech.html, 2 pages, printed Oct. 31, 2006.

(Continued)

*Primary Examiner*—John Ricci
(74) *Attorney, Agent, or Firm*—Woodard, Emhardt, Moriarty, McNett & Henry LLP

(57) ABSTRACT

An arrowhead assembly and a method for assembling an arrowhead are provided. The arrowhead of the disclosure is secured to an inside portion of the arrow shaft and the outside portion of the arrow shaft. In some embodiments the arrow tip threads into an insert that is secured within the tip of the arrowhead. Also, in some embodiments, a sleeve extends over the end of the arrow shaft and is radially compressed onto the shaft.

22 Claims, 9 Drawing Sheets

OTHER PUBLICATIONS

The Bowman's Archery Catalog, Wooden Shafts, http://www.thebowman.com/mall/carr_woodshaft.asp, 3 pages, printed Sep. 12, 2005.

Ye Olde Archery Shoppe, Zwickey Broadheads, http://yeoldearcheryshoppe.com/broadheads-zwickey-c-23_180.html, 2 pages, printed Sep. 12, 2005.

Archery History, Index, http://www.archeryhistory.com/index.php, 2 pages, printed Sep. 12, 2005.

Archery History, Broadheads, http://www.archeryhistory.com/broadheads/broadmain.htm, 4 pages, printed Sep. 12, 2005.

Archery History, Global Buttons, http://www.archeryhistory.com/buttons.htm, 2 pages, printed Sep. 12, 2005.

* cited by examiner

ARROWHEAD ASSEMBLY

CROSS REFERENCE TO RELATED APPLICATIONS

This application claims the benefit of U.S. Provisional Patent Application Ser. No. 60/704,813 filed Aug. 1, 2005 and U.S. Provisional Patent Application Ser. No. 60/755,204 filed Dec. 30, 2005, which applications are hereby incorporated by reference in their entirety.

TECHNICAL FIELD

The present invention relates generally to archery equipment. More particularly, the present invention relates to arrowhead assemblies.

BACKGROUND

Typical arrowheads are mounted in front of an arrow shaft. For example, typically arrowheads are secured to an insert that is glued or otherwise secured into the interior of the front end of the arrow shaft. An example arrowhead having this type of configuration is disclosed in U.S. Pat. No. 6,921,348, which is hereby incorporated by reference.

The arrowhead mounting configuration described above typically requires a high level of concentricity tolerance to keep the arrowhead centered with the arrow. If concentricity is out of tolerance, the arrow will not follow a straight path during flight. Moreover, the mounting configuration can result in damaged arrow shafts when hard objects are impacted by the arrowhead.

SUMMARY

One aspect of the present disclosure relates to an arrowhead assembly having individually removable blades that at least partially overlap the exterior of an arrow shaft.

Another aspect of the disclosure relates to an arrowhead assembly including a first portion that fits inside the interior of an arrow shaft, and a second portion that at least partially engages the exterior of the arrow shaft at a location rearward of the front end of the arrow shaft.

A further aspect of the disclosure relates to an arrowhead configuration that provides automatic centering of cutting blades with respect to the arrow shaft.

Still another aspect of the disclosure relates to an arrowhead assembly that includes at least two securement locations for engaging the arrow shaft.

A further aspect of the disclosure relates to an arrowhead assembly having a compression collet or other retention structure that is clamped about the exterior of the arrow shaft. In certain embodiments, the retention structure radially clamps the arrow shaft. In certain embodiments, the retention structure is positioned at a location set back from the front end of the arrow shaft.

A further aspect of the disclosure relates to an arrowhead assembly having an over-the-shaft sleeve that extends at least partially over the exterior of the arrow shaft, and expandable blades pivotally connected to the over-the-shaft sleeve.

Another aspect of the disclosure relates to an expandable arrowhead assembly having blades with pivot locations positioned around an exterior of the arrow shaft at a location rearwardly offset from the front end of the arrow shaft.

A variety of additional inventive aspects will be set forth in the description that follows. The inventive aspects can relate to individual features and to combinations of features. It is to be understood that both the forgoing general description and the following detailed description are exemplary and explanatory only and are not restrictive of the broad inventive concepts upon which the embodiments disclosed herein are based.

DETAILED DESCRIPTION

Figure 1:
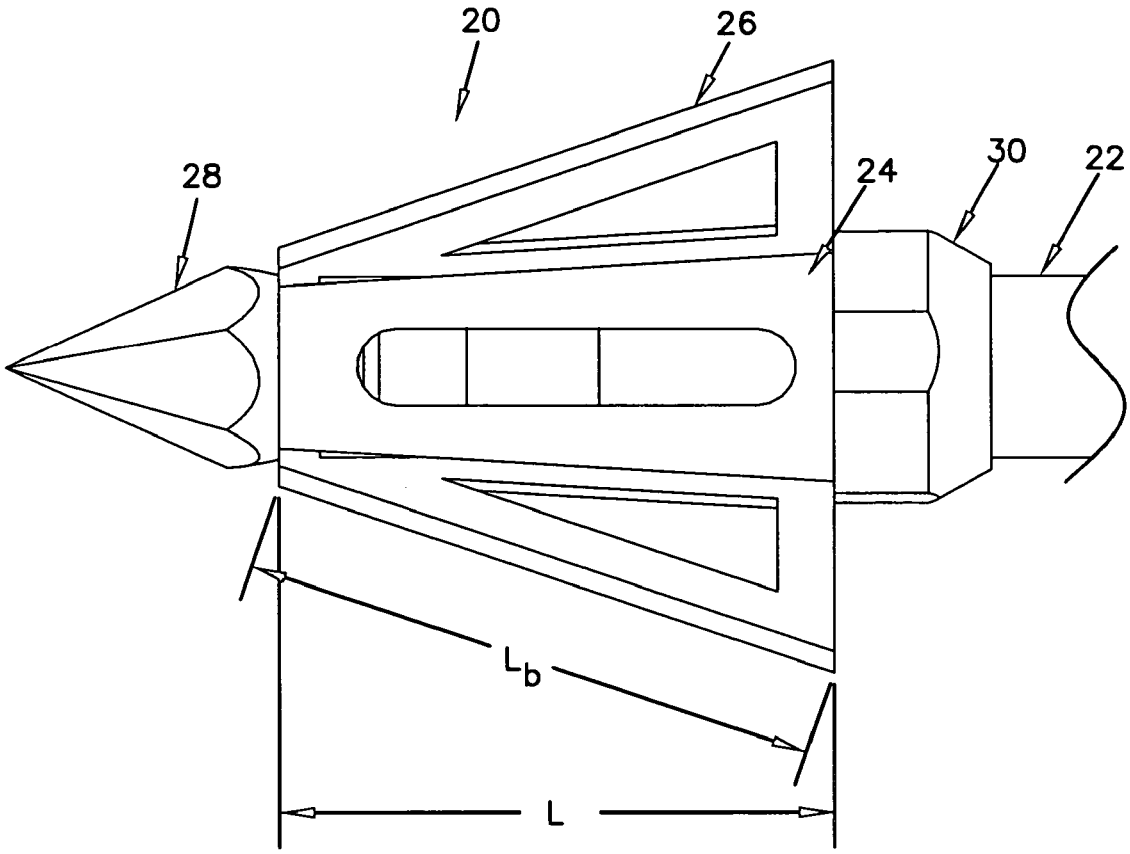
FIG. 1 is a side view of a first embodiment of an arrowhead assembly having features that are examples of inventive aspects in accordance with the principles of the present disclosure.

FIGS. 1-4 illustrate an arrowhead assembly 20 having features that are examples of the inventive aspects in accordance with the principles of the present disclosure. The arrowhead assembly 20 is mounted adjacent the forward end of an arrow shaft 22. The arrowhead assembly 20 includes an over-the-shaft sleeve 24 having at least a portion mounted over an exterior circumferential surface of the arrow shaft 22. The arrowhead assembly 20 also includes a plurality of fixed, broadhead blades 26 mounted within longitudinal grooves defined by the over-the-shaft sleeve 24. A tip 28 is mounted at the front end of the over-the-shaft sleeve 24. A compression collar 30 is mounted at the rear end of the over-the-shaft sleeve 24. The tip 28 and the compression collar 30 cooperate to retain the broadhead blades 26 within the grooves of the over-the-shaft sleeve 24.

Figure 3:
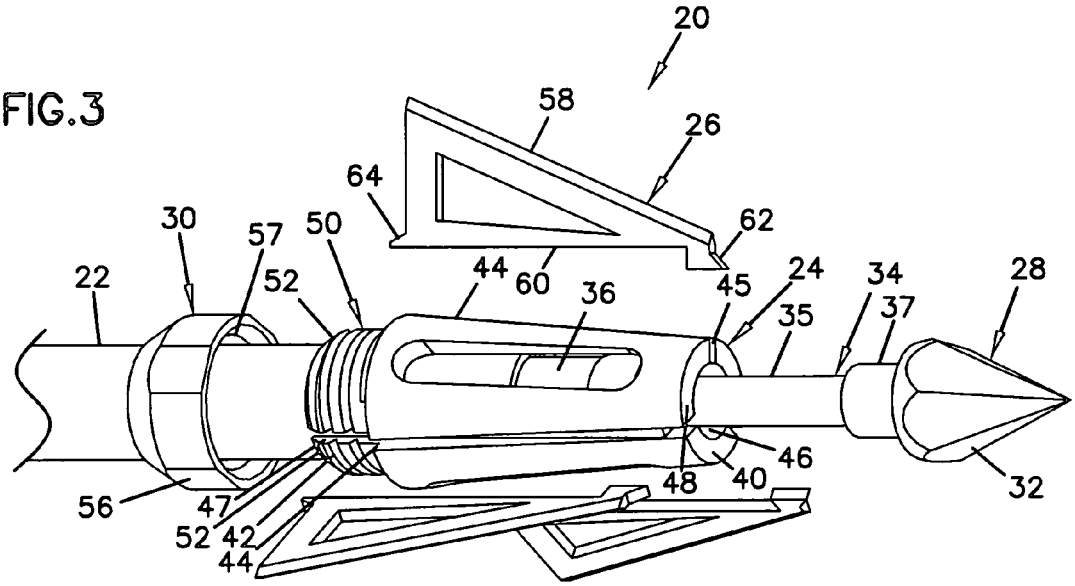
FIG. 3 is a front, side exploded perspective view of the arrowhead assembly of FIG. 1.

Referring to FIG. 3, the tip 28 includes a tapered tip portion 32 and a shank 34 (i.e., a ferrule) that extends rearwardly from the tapered tip portion 32. The tapered tip portion 32 can be hardened or unhardened. The shank 34 includes a threaded portion 35 and a centering portion 37 (i.e., a shoulder portion). The centering portion 37 has a larger diameter than the threaded portion 35. The back side of the tapered tip portion 32 is undercut (see FIG. 4) to define an annular tab receiving cavity 39. The threaded portion 35 is adapted to thread within an internally threaded opening of an insert 36 secured to the front end of the arrow shaft 22. In certain embodiments, the insert 36 includes a portion that fits within the interior of the arrow shaft 22 and is secured within the interior of the arrow shaft 22 by conventional means (e.g., glue, friction or other techniques).

The over-the-shaft sleeve 24 includes a front end 40 and a back end 42. Grooves 44 for receiving the broadhead blades 26 extend generally from the front end 40 to the back end 42 of the over-the-shaft sleeve 24. The grooves 44 include through-portions 45 located at the front of the over-the-shaft sleeve 24 and through-portions 47 located at the back of the over-the-shaft sleeve 24. The through-portions 45, 47 extend completely through the wall of the over-the-shaft sleeve 24, while central regions 49 of the grooves 44 extend only partially through the wall of the over-the-shaft sleeve 24.

As shown at FIG. 3, the front end 40 of the over-the-shaft sleeve 24 defines a central opening 46 and also defines a forwardly facing end face 48. The back end 42 of the over-the-shaft sleeve 24 includes a clamping collet 50 having a plurality of collet segments 52 separated from one another by the through-portions 47 of the grooves 44. The clamping collet 50 can include a tapered outer diameter, with the diameter increasing as the clamping collet 50 extends in a forward direction. Exterior threads are provided at the outside of the clamping collet 50. In certain embodiments, the clamping collet can include at least 2, 3 or 4 separate collet segments.

Figure 4:
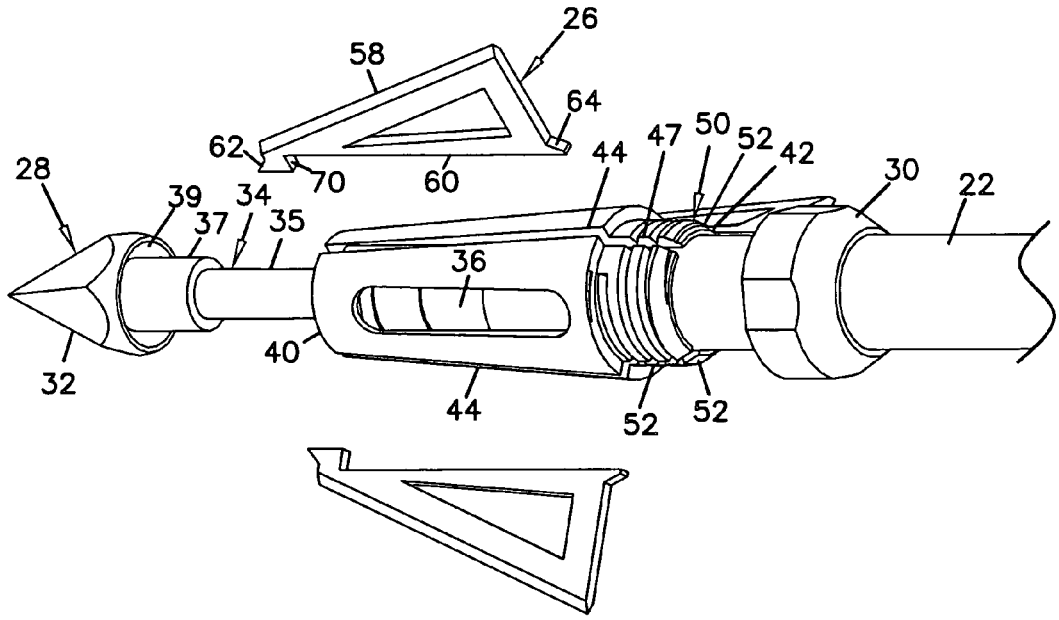
FIG. 4 is a rear, side exploded perspective view of the arrowhead assembly of FIG. 1.
Figure 5:
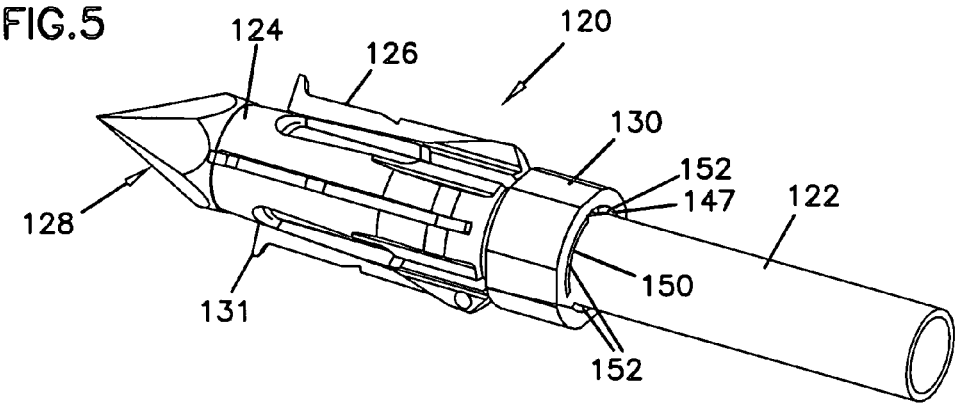
FIG. 5 is a rear, side, top perspective view of a second embodiment of arrowhead assembly having features that are examples of inventive aspects in accordance with the principles of the present disclosure, the arrowhead assembly is expandable and is shown in a retracted orientation.
Figure 6:
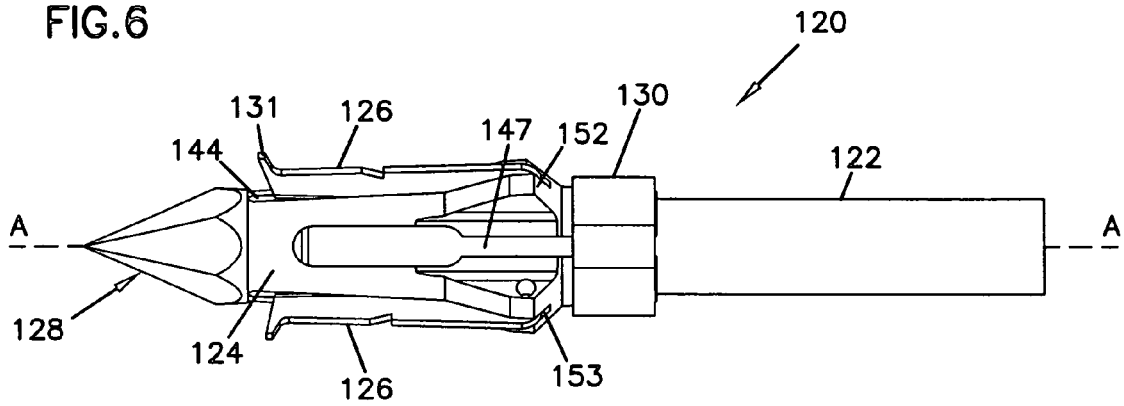
FIG. 6 is a top view of the retracted arrowhead assembly of FIG. 5.
Figure 7:
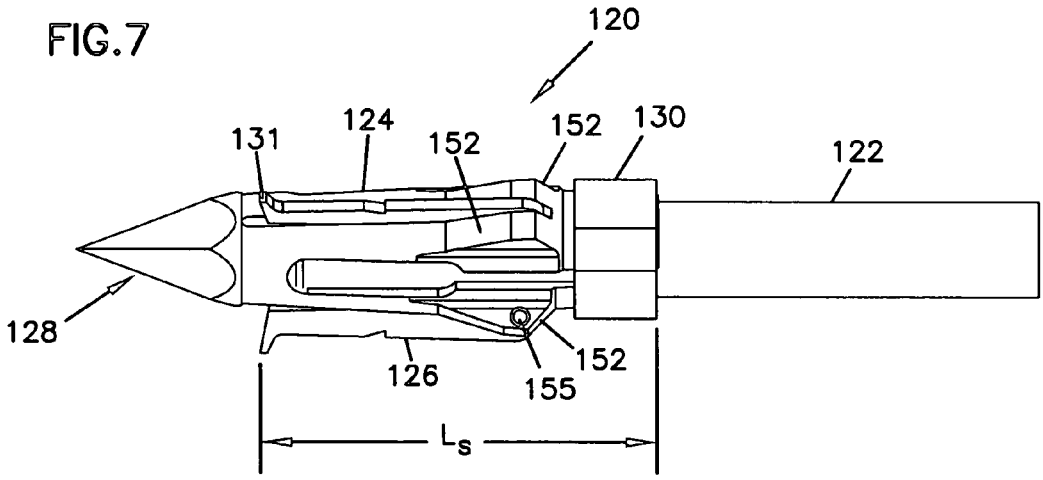
FIG. 7 is a side view of the retracted arrowhead assembly of FIG. 5.
Figure 8:
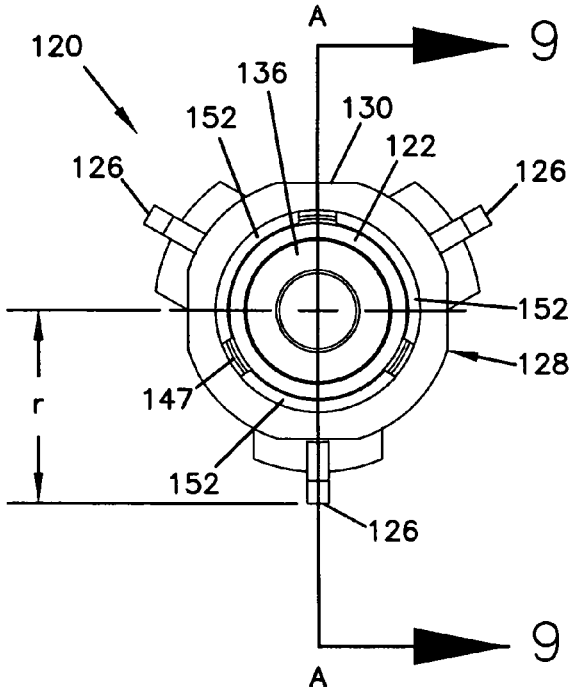
FIG. 8 is a back end view of the retracted arrowhead assembly of FIG. 5.

Referring to FIGS. 3 and 4, the compression collar 30 is sized to be threaded over the exterior of the clamping collet 50. The compression collar 30 includes interior threads adapted to intermesh with the exterior threads of the clamping collet 50 when the arrowhead assembly 20 is assembled. The compression collar 30 can include exterior wrench flats 56 for facilitating applying torque to the compression collar 30 during tightening. As shown at FIG. 3, the front side of the collar 30 is undercut or recessed to define a tab receiving cavity 57.

The broadhead blades 26 include exterior cutting edges 58 spaced outwardly from interior edges 60. The interior edges 60 are adapted to fit within the grooves 44 of the over-the-shaft sleeve 24. The broadhead blades 26 also include front tabs 62 and rear tabs 64. When the arrowhead assembly 20 is assembled, the front tabs 62 fit within the tab receiving cavity 39 of the tip 28, and the rear tabs 64 fit within the tab receiving cavity 57 of the compression collar 30. The front tabs 62 can include inward radial extensions 70 for insetting the front tabs 62 through the through-portions 45 of the grooves 44.

To assemble the arrowhead assembly 20, the insert 36 is first mounted within the tip of the arrow shaft 22. The compression collar 30 is then slid over the exterior of the arrow shaft 22. Thereafter, the over-the-shaft sleeve 24 is slid over the arrow shaft 22 until the front end 40 of the over-the-shaft sleeve 24 abuts against the insert 36. As so positioned, a majority of the length of the over-the-shaft sleeve 24 overlies the exterior of the arrow shaft 22 and the clamping collet 50 is rearwardly offset from the insert 36. The broadhead blades 26 can then be inserted into the grooves 44, and the tip 28 can be threaded into the insert 36 with the front tabs 62 of the blades 26 captured within the tab receiving cavity 66 of the tip 28. The threaded portion 34 of the tip shank can be threaded within the insert 36 until the backside of the tapered tip portion 32 abuts against the front end face 48 of the over-the-shaft sleeve 24. As so positioned, the centering portion 37 of the tip 28 fits within the center opening 46 of the over-the-shaft sleeve 24 to maintain an axial alignment between the over-the-shaft sleeve 24 and the tip 28. The compression collar 30 can then be threaded over the clamping collet 50. As the compression collar 30 is threaded over the clamping collet 50, the collet segments 52 are compressed radially inwardly and caused to securely clamp the exterior surface of the arrow shaft 22. This radial clamping action assists in centering the cutting blades relative to the arrow shaft thereby reducing the likelihood of concentricity problems. Additionally, the clamping action provides a securement location for securing the arrowhead assembly 20 to the arrow shaft 22. This securement location cooperates with the securement location provided at the insert 36 to provide the arrowhead assembly with enhanced structural integrity. As the compression collar 30 is tightened, the rear tabs 64 of the broadhead blades 26 are also captured within the tab receiving cavity 57 of the compression collar 30 thereby affixing the blades 26 in place.

In the embodiment of FIGS. 1-4, the broadhead blades 26 can be individually removed from the over-the-shaft sleeve 24 and replaced as needed. For example, it may be desirable to replace the blades if the blades become worn or damaged with use. It will be appreciated that the broadhead blades 26 can be easily removed by unthreading the compression collar 30, and then removing the blades 26 from the grooves 44 of the over-the-shaft sleeve 24.

Figure 2:
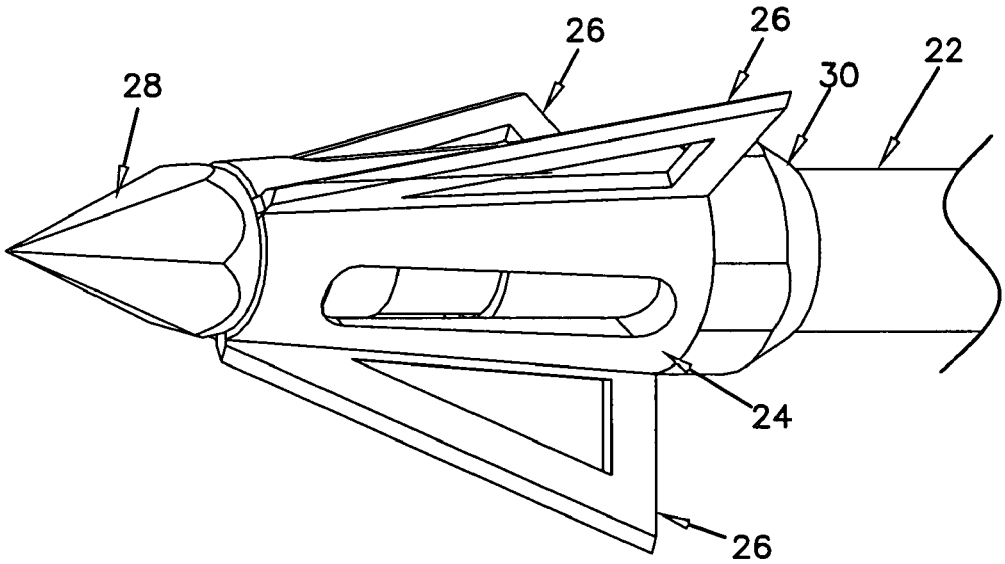
FIG. 2 is a perspective view of the arrowhead assembly of FIG. 1.

Still referring to FIGS. 1-3, the blades 26 have lengths $L_B$ measured in a direction parallel to the longitudinal axis of the shaft 22. In certain embodiments, a majority of the length L of each blade overlaps the shaft 22. In other embodiments, all or substantially all of the length L of each blade 26 overlaps the shaft 22. In still other embodiments, at least a portion of the length L of each blade 26 overlaps the shaft 22. In certain embodiments, the blades 26 that at least partially overlap the arrow shaft 22 are individually removable/disconnectable from the shaft 22. Such embodiments may include blades having front and rear ends, a front blade retainer anchored to an interior of the arrow shaft, and a rear blade retainer positioned over the arrow shaft for securing the rear ends of the blades to the shaft. Additionally, certain embodiments in accordance with the principles of the present disclosure may include over-the-shaft sleeves that overlap (e.g., are coextensive with) their corresponding arrow shafts for at least ½, or ¾ or substantially all of the lengths of the sleeves.

FIGS. 5-14 illustrate another arrowhead assembly 120 having features that are examples of inventive aspects in accordance with the principles of the present disclosure. The arrowhead assembly 120 is mounted adjacent the forward end of an arrow shaft 122. The arrowhead assembly 120 includes an over-the-shaft sleeve 124 having at least a portion mounted over a surface of the arrow shaft 122 that faces radially outwardly with respect to a longitudinal axis A of the shaft. The arrowhead assembly 120 also includes a tip 128 that mounts at the front end of the over-the-shaft sleeve 124. The tip is anchored to the shaft 122 by an insert 136 that fits within the interior of the arrow shaft 122. The arrowhead assembly 120 further includes a compression collar 130 that mounts at a rear end of the over-the-shaft sleeve 124. The tip 128 and the compression collar 130 cooperate to secure the over-the-shaft sleeve 124 to the arrow shaft 122. The arrowhead assembly 120 further includes expandable blades 126 connected to the over-the-shaft sleeve 124.

The blades 126 of the arrowhead assembly 120 are pivotally movable relative to the over-the-shaft sleeve 124 between a retracted orientation (see FIGS. 5-9) and an expanded position (see FIGS. 10-14). In the retracted position, the blades 126 are pivoted forwardly so as to be in contact with the over-the-shaft sleeve 124. In such a position, the blades 126 are generally parallel to the longitudinal axis A of the arrow shaft 122. The blades 126 can include notches 127 for positioning a retainer (e.g., a rubber band) that encircles the blades 126 to hold the blades in the retracted orientation during flight of the arrow. Upon impact with a target, forward tips 131 of the blades 126 contact the target causing the blades 126 to pivot rearwardly and radially outwardly to the expanded orientation of FIGS. 10-14. As the blades 126 move toward the expanded orientation, the retaining member (e.g., the rubber band) can be configured to break so as to not interfere with the expansion of the blades at impact. In the expanded orientation of FIGS. 10-14, cutting edges 129 of the blades 126 face forwardly and provide a relatively large cutting radius R. In the retracted orientation, the blades define a narrow flight radius r with the cutting edges 129 facing toward the over-the-shaft sleeve 124 and only the forward tips 131 being exposed. As shown in FIGS. 5-9, the over-the-shaft sleeve 124 can include slots or grooves 144 for receiving the blades 126 when the blades are pivoted to the retracted orientation.

As shown in FIGS. 5-9, at least 75% of a length $L_S$ of the over-the-shaft sleeve 124 overlaps or is coextensive with the outer surface of the arrow shaft 122. In other embodiments, at least 50% of the length of the over-the-shaft sleeve 124 overlaps (e.g., is coextensive with) the outer surface of the arrow shaft 122. Additionally, the over-the-shaft sleeve 124 is configured such that the pivot points of the blades 126 are set back relative to the front end of the arrow shaft 122. Thus, the pivot points are spaced about the circumference of the exterior radial surface of the arrow shaft. When the blades 126 are in the retracted orientation, a majority of the lengths of the blades 126 overlap and are generally parallel to the exterior radial/cylindrical surface of the arrow shaft. In certain embodiments, the pivot points of the blades can be positioned at least one half of a blade length behind the front end of the arrow shaft. In other embodiments, the pivot points of the blades can be positioned at least ¾ of a blade length behind the front end of the arrow shaft. In still other embodiments, the pivot points of the blades can be positioned substantially a full blade length behind the front end of the arrow shaft.

Figure 9:
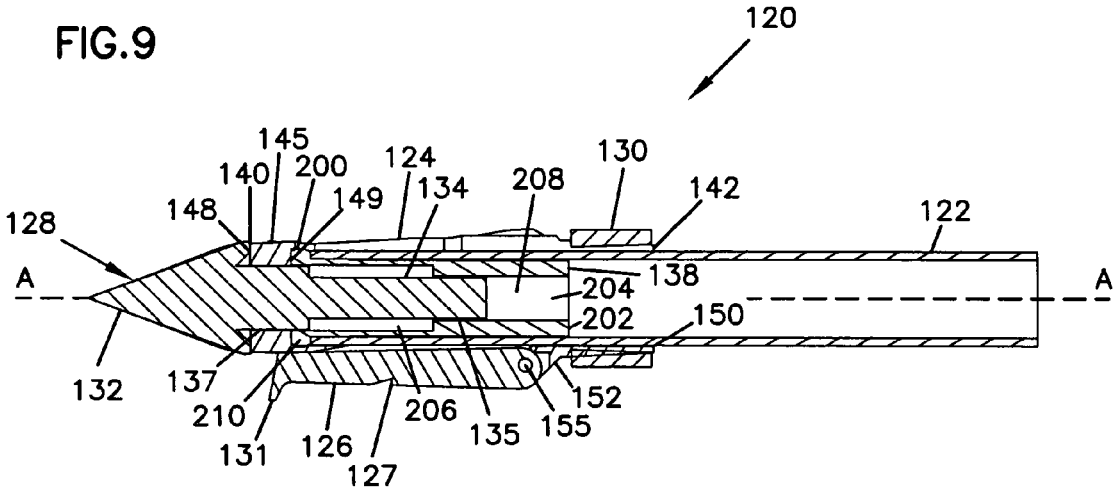
FIG. 9 is a cross-sectional view taken along section line 9-9 of FIG. 8.
Figure 10:
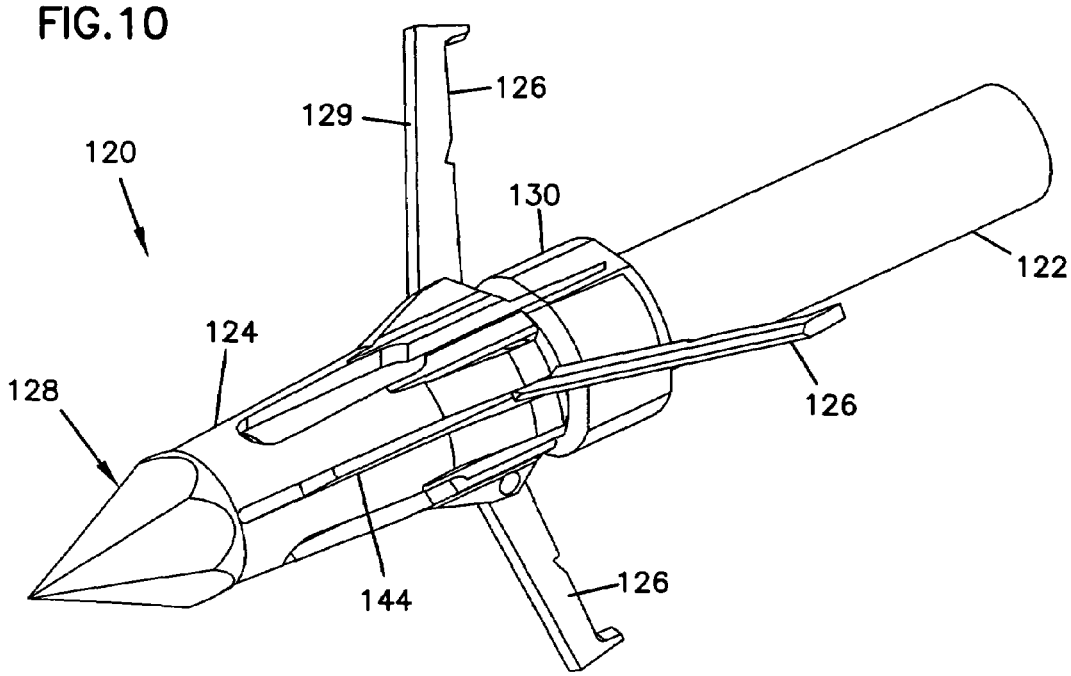
FIG. 10 is a front, side, and top perspective view of the arrowhead assembly of FIG. 5 shown in an expanded orientation.
Figure 11:
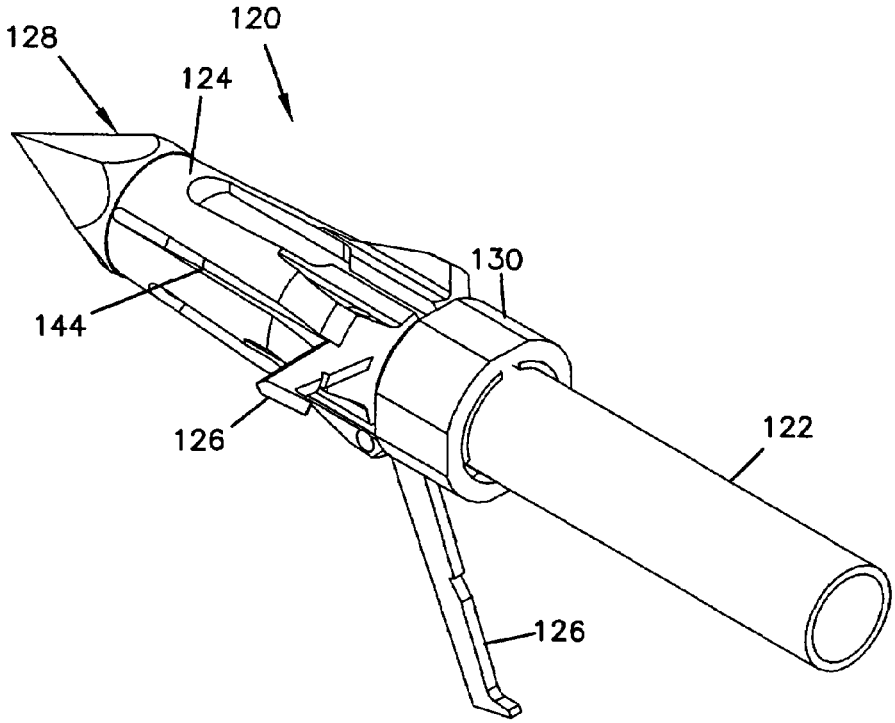
FIG. 11 is a rear, side, and top perspective view of the expanded arrowhead assembly of FIG. 10.
Figure 12:
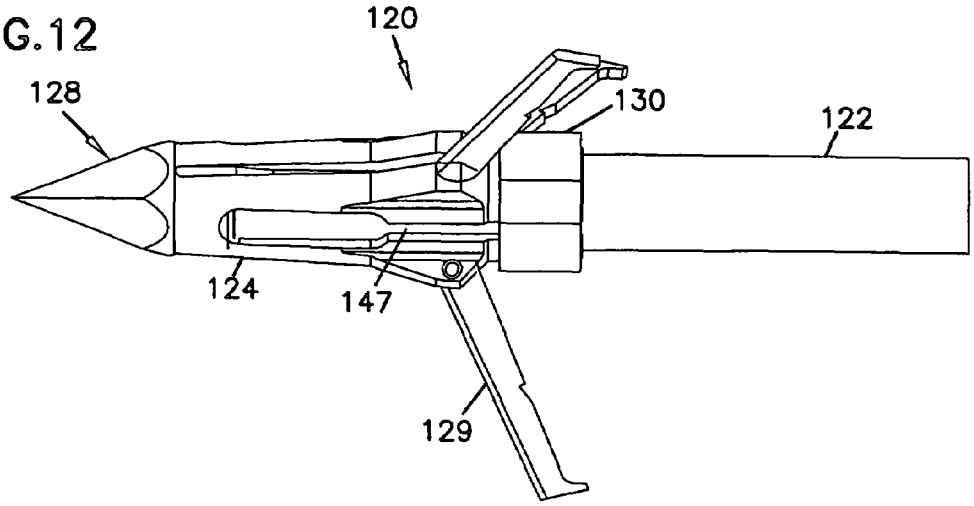
FIG. 12 is a side view of the expanded arrowhead assembly of FIG. 11.
Figure 13:
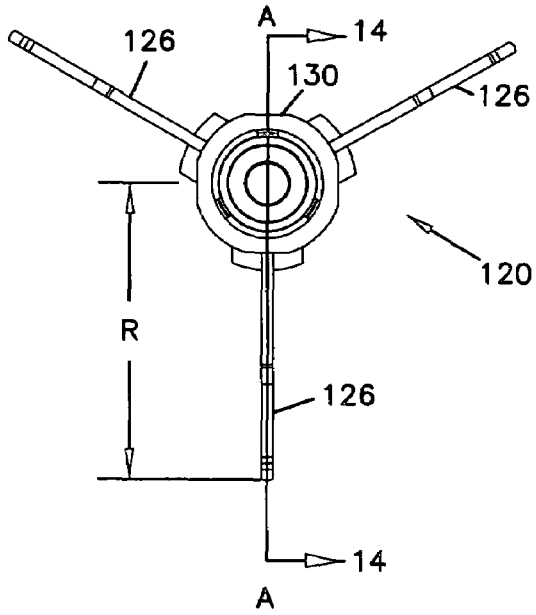
FIG. 13 is a back end view of the expanded arrowhead assembly of FIG. 11.
Figure 14:
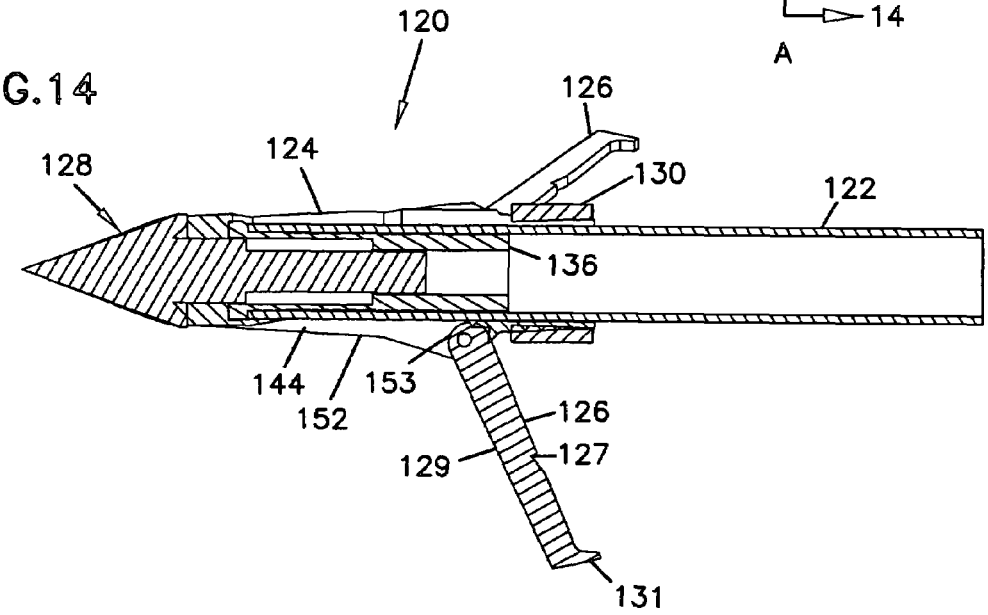
FIG. 14 is a cross-sectional view taken along section line 14-14 of FIG. 13.
Figure 15:
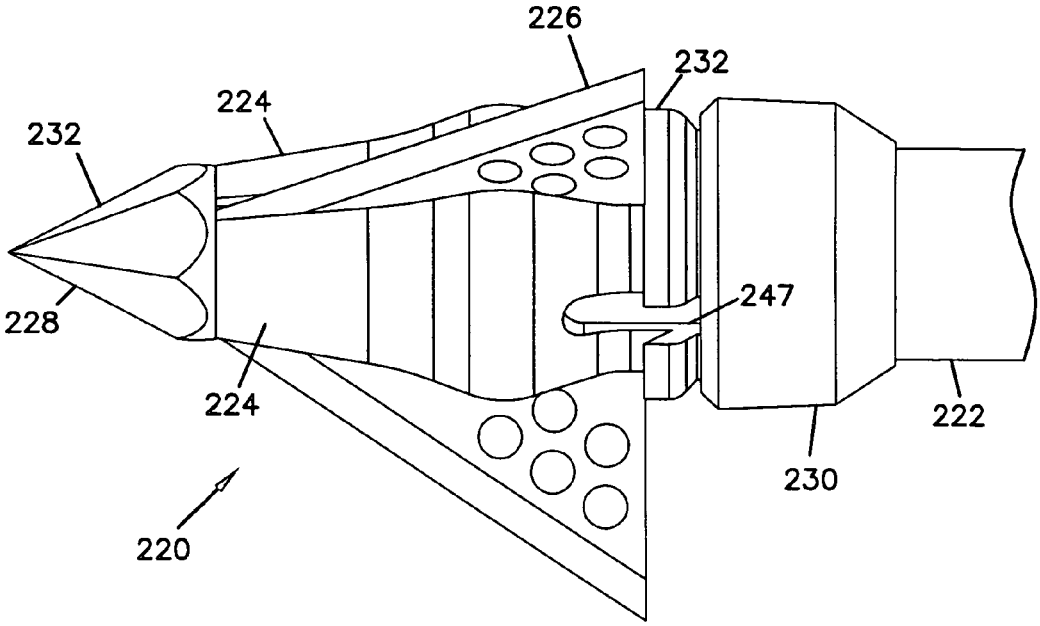
FIG. 15 is a side view of a third alternative embodiment of an arrowhead assembly having features that are examples of inventive aspects in accordance with the principles of the present disclosure.
Figure 16:
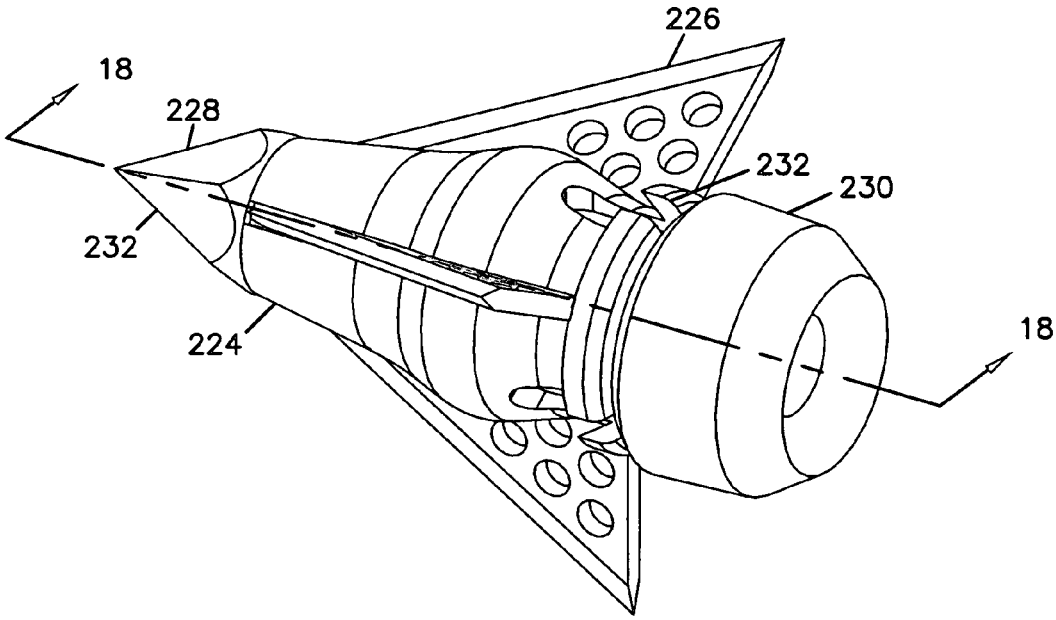
FIG. 16 is a rear, side, top perspective view of the arrowhead assembly of FIG. 15.
Figure 17:
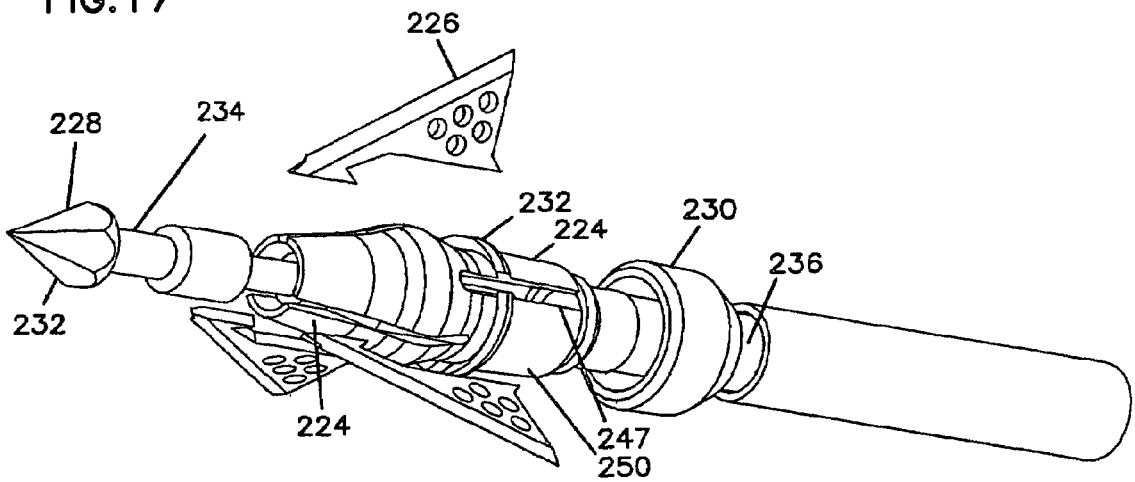
FIG. 17 is a front, side exploded perspective view of the arrowhead assembly of FIG. 15.
Figure 18:
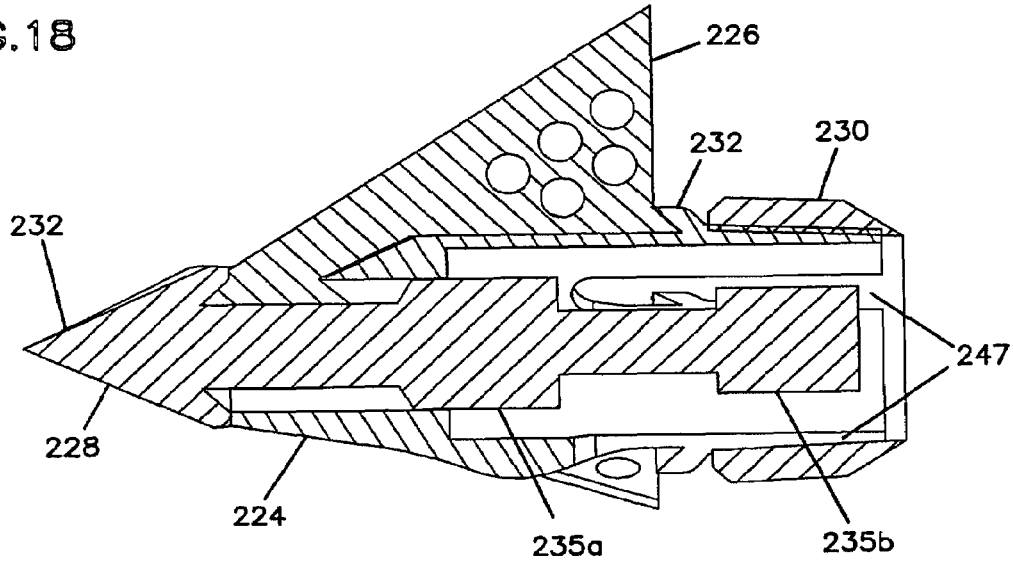
FIG. 18 is a cross-sectional view taken along section line 18-18 of FIG. 16.

Referring to FIG. 9, the insert 136 is generally cylindrical and includes a front end 200 and a rear end 202. A central passage 204 extends through the insert 136 from the front end 200 to the rear end 202. The central passage 204 includes an increased diameter portion 206 positioned adjacent the front end 200 and a reduced diameter portion 208 positioned adjacent the rear end 202. The reduced diameter portion 208 is internally threaded. An annular flange 210 is located at the front end 200 of the insert 136. The main body of the insert 136 fits within the interior of the arrow shaft 122 and is secured within the interior of the arrow shaft 122 by conventional means (e.g., glue, friction, crimping, or other techniques). When the insert 136 is mounted within the arrow shaft 122, the annular flange 210 seats against the front end of the arrow shaft 122 as shown at FIG. 9.

In the depicted embodiments, the insert is shown as a separate piece from the tip. In other embodiments, the insert can be an integral or unitary part of the tip. In either case, the insert functions as an anchor for securing the tip to the arrow shaft.

The over-the-shaft sleeve 124 of the arrowhead assembly 120 is depicted as having a generally cylindrical main body having a length that extends from a front end 140 and a back end 142. The over-the-shaft sleeve 124 is hollow and defines a central opening that extends from the front end 140 to the back end 142. A front stop 145 is positioned at the front end of the over-the-shaft sleeve 124. The front stop 145 defines a forwardly facing end face 148, and a rearwardly facing shoulder 149. The back end 142 of the over-the-shaft sleeve 124 includes a clamping collet 150 having a plurality of collet segments 152 (e.g., 2, 3, 4 or more collet segments). The collet segments 152 are separated from one another by longitudinal slots 147 that extend through the over-the-shaft sleeve 124. The clamping collet 150 can include a tapered outer diameter, with the outer diameter increasing as the clamping collet 150 extends in a rearward direction. Exterior threads are provided at the outer surface of the clamping collet 150. The over-the-shaft sleeve 124 also includes pivot pin mounts 152 that project outwardly from the main body of the over-the-shaft sleeve 124. Slots 153 for receiving base ends of the blades 126 are provided between the pivot mounts 151. Pivot pins 155 extend through the base ends of the blades 126. The pivot pins 153 have ends secured within the pivot mounts 151.

The tip 128 of the arrowhead assembly 120 includes a tapered tip portion 132 and a ferrule 134 that extends rearwardly from the tapered tip portion 132. The tapered tip portion 132 may be hardened or unhardened. The ferrule 134 includes a threaded portion 135 and a shoulder portion 137. The shoulder portion 137 has an outer diameter that is sized to fit with relatively close tolerance within the inside of the front stop 145 of the over-the-shaft sleeve 124. The shoulder portion 137 also fits with relatively close tolerance within the flange 210 of the insert 136. The threaded portion 135 of the ferrule 134 is adapted to thread within the reduced diameter portion 208 of the insert 136.

The compression collar 130 of the arrowhead assembly 120 is a generally cylindrical nut having exterior wrench flats for allowing torque to be applied to the compression collar 130 for tightening the collar 130. The compression collar 130 includes an inner diameter that is tapered such that the inner diameter increases as the compression collar 130 extends in a rearward direction. The inner surface of the collar 130 is threaded to match the exterior threads provided on the clamping collet 150. By threading the compression collar 130 rearwardly on the clamping collet 150, the collet segments 152 of the clamping collet 150 are forced radially inwardly causing the inner diameter of the clamping collet 150 to decrease. In this manner, by threading the compression collar 130 rearwardly on the clamping collet 150, the clamping collet 150 can be clamped tightly about the circumference of the exterior surface of the arrow shaft 122.

To assemble the arrowhead assembly 120, the insert 136 is first provided within the front end of the arrow shaft. The back end 142 of the over-the-shaft sleeve 124 is inserted over the front end of the arrow shaft 122 and slid along the arrow shaft until the shoulder 149 of the front stop 147 abuts against the flange 210 of the insert 136. The ferrule 134 of the tip 128 is then inserted through the front end 140 of the over-the-shaft sleeve 124 and into the insert 136. The threaded portion 135 of the ferrule 134 is then threaded into the reduced diameter portion 208 of the insert 13 until a back side of the tapered tip portion 132 seats firmly against the forwardly facing end face 148 of the front stop 147 of the over-the-shaft sleeve 124. As so positioned, the shoulder portion 137 of the tip 128 fits in relatively close tolerance within the front stop 147 of the over-the-shaft sleeve 124 and the flange 210 of the insert 136. To complete the assembly process, the compression collar 130 is threaded rearwardly on the clamping collet 150 causing the collet to clamp securely about the outer cylindrical surface of the shaft 122. Similar to the previous embodiment, this clamping action is radial in nature and assists in centering the blades relative to the arrow shaft thereby reducing the likelihood of concentricity problems.

FIGS. 15-18 illustrate another arrowhead assembly 220 having features that are examples of inventive aspects in accordance with the principles of the present disclosure. Similar to the embodiments described above, the arrowhead assembly 220 is mounted adjacent the forward end of an arrow shaft 222. The arrowhead assembly 220 includes a sleeve 224 having at least a portion mounted over a surface of the arrow shaft 222 that faces radially outwardly with respect to a longitudinal axis of the shaft. The arrowhead assembly 220 also includes a tip 228 that mounts at the front end of the over-the-shaft sleeve 224. The tip 228 is anchored to the shaft 222 by an insert 236 that fits within the interior of the arrow shaft 222. The arrowhead assembly 220 further includes a compression collar 230 that mounts a compression collet 250 at the rear end of the sleeve 224. The tip 228 and the compression collar 230 cooperate to secure the sleeve 224 to the arrow shaft 222. In one embodiment, the sleeve 224 has a diameter that is at least about ⅕, or ¼, or ⅓ of the length of the sleeve 224.

More particularly, the arrowhead assembly 220 includes a plurality of fixed blades 226 that include a plurality of apertures therein. The blades 226 have a front tab 262 and a rear tab 264 that are configured to engage the sleeve 224. The front tab 262 is sized and shaped to fit between the sleeve 224 and an undercut portion 239 of the tip 228. The rear tab 264 is sized and shaped to engage a stop 231 on the sleeve 224. The stop 231 is depicted as an annular undercut portion of the sleeve 224. When the front tab 262 of the blade 226 is held between the tip 228 and the sleeve, the stop 231 helps prevent the blade 226 from moving rearwardly or radially. The blades 226 in the depicted embodiment are fit within grooves 244 on the sleeve 224. The grooves 244 are shown offset from through slots 247 on the sleeve 224. The grooves 244 aid in securing the blades 226 in place on the sleeve 224. The through slots 247 allow the rear portion of the sleeve to deflect radially when the collar 230 is tightened.

The tip 228 includes a tapered tip portion 232 and a shank 234 (i.e., a ferrule) that extends rearwardly from the tapered tip portion 232. The tapered tip portion 232 is similar to the tapered tip portion 32 in the embodiment shown in FIGS. 1-4. One difference is that in the present embodiment the tip portion 232 has a smaller diameter than the arrow shaft 222, whereas the tip portion 32 in the embodiment shown in FIGS. 1-4 has a diameter that is approximately the same as the shaft 22. Another difference is that the shank 234 includes a stepped configuration. The threaded portions 235*a* and 235*b* are larger in diameter than other portions of the shank 234. This construction allows a shank construction 234 that is relatively lighter than a non stepped shank. In the depicted embodiment the first treaded portion 235*a* is larger in diameter than the second treaded portion 235*b*. In should be appreciated that many other shank 234 profiles are also possible. For example, the shank may be threaded along its entire length.

The sleeve 224 is generally similar to the sleeve 24 in the embodiment illustrated in FIGS. 1-4. As discussed above, one difference is that the grooves 244 and through slots 247 are not aligned and the sleeve 224 includes a stop 231. According to the present embodiment the blades can be inserted and removed without loosening the collet 230, as the collet 230 does not directly engage the blades 226. Another difference is that the diameter of the sleeve 224 varies along its length. The front part has a relatively small diameter that is substantially equal to the diameter of the tip portion 232 of the tip 228. The rear portion has a diameter that is substantially similar to the diameter of the collet 230. The collet 230 is sized to be threaded over the exterior of the clamping collet 250. The compression collar 230 may include interior threads adapted to intermesh with the exterior threads of the clamping collet 250 when the arrowhead assembly 220 is assembled.

To assemble the arrowhead assembly 220, the insert 236 is first mounted within the tip of the arrow shaft 222. The compression collar 230 is then slid over the exterior of the arrow shaft 222. Thereafter, the sleeve 224 is slid over the arrow shaft 222 until the sleeve 224 abuts against the insert 236. As so positioned, the clamping collet 250 of the sleeve 224 overlies the exterior of the arrow shaft 222. The compression collar 230 can be tightened to secure the sleeve 224 onto the shaft 222 before or after the blades 226 are secured onto the sleeve 224. The blades are secured onto the sleeve by positioning the blades 226 into the grooves 244, and threading the tip 228 into the insert 236 with the front tabs 262 of the blades 226 captured between the tip 228 and the sleeve 224. According to the above method the blades can be replaced without removing or loosening the collet 230. Though in the depicted embodiment the blades shown do not overlap the shaft 222, it should be appreciated that in other embodiments, the blades 226 may overlap the shaft 222.

Figure 19:
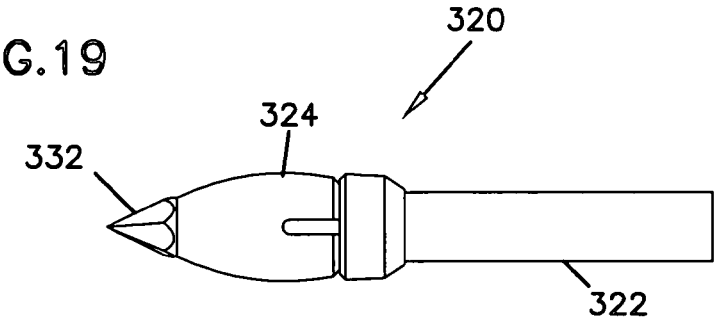
FIG. 19 is a side view of a fourth embodiment of an arrowhead assembly having features that are examples of inventive aspects in accordance with the principles of the present disclosure.
Figure 20:
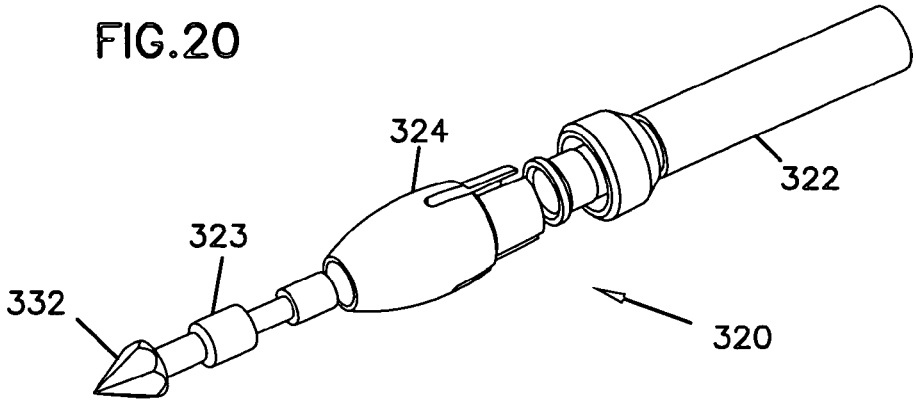
FIG. 20 a front, side exploded perspective view of the arrowhead assembly of FIG. 19.
Figure 21:
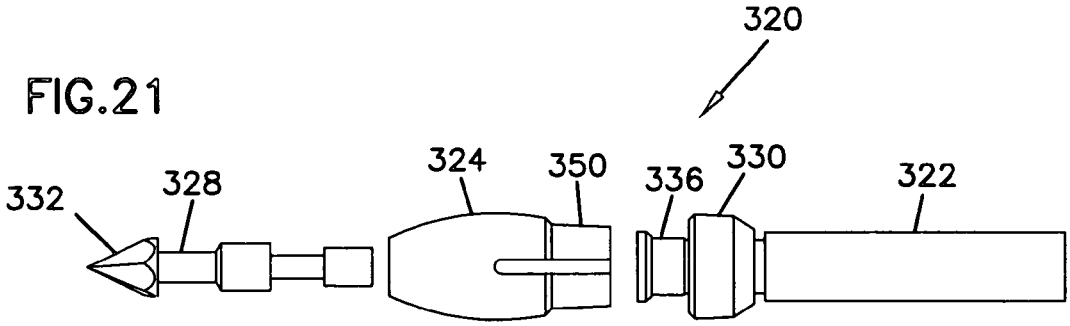
FIG. 21 is side exploded view of the arrowhead assembly of FIG. 19.

FIGS. 19-21 illustrate another arrowhead assembly 320 having features that are examples of inventive aspects in accordance with the principles of the present disclosure. The arrowhead assembly 320 is similar to the arrowhead assembly 230 described above. The arrowhead assembly 320 is mounted adjacent the forward end of an arrow shaft 322. It includes a sleeve 324 having at least a portion mounted over a surface of the arrow shaft 322 that faces radially outwardly with respect to a longitudinal axis of the shaft. The arrowhead assembly 320 also includes a tip 328 that mounts at the front end of the over-the-shaft sleeve 224. The tip 328 is anchored to the shaft 222 by an insert 336 that fits within the interior of the arrow shaft 322. The arrowhead assembly 320 further includes a compression collar 330 that mounts a compression collet 350 at the rear end of the sleeve 324. The tip 328 and the compression collar 330 cooperate to secure the sleeve 324 to the arrow shaft 322.

The primary differences between the arrowhead assembly 320 and the arrowhead assembly 220 relate to the configuration of the sleeve 324 and the fact that the arrowhead assembly 320 does not include blades. The arrowhead assembly 320 is commonly referred to as a filed point, and is typically used for target shooting rather than hunting. The sleeve 320 has a diameter that varies along its length to transition between the tip portion 332 of the tip 328 and the larger diameter collet 330. The tip 328 shares the same construction as the tip 228, but includes a stepped shank configuration. Assembly of the arrowhead assembly 320 is similar to the assembly of the arrowhead assembly 220, less the step of securing blades to the sleeve.

It will be appreciated that the various components of the arrow assemblies disclosed herein can be manufacturing of metal, ceramic, or other materials. In certain embodiments, the various components can be machined parts. In other embodiments, the components can be molded parts. For example, the various components can be molded using metal injection molding techniques of the type disclosed in U.S. Pat. No. 6,260,903, which is hereby incorporated by reference in its entirety.

Another aspect of the disclosure relates to a method for securing an arrowhead to a shaft where the arrowhead is coupled to an outer cylindrical surface of an arrow shaft. The arrowhead may be coupled/secured to the exterior cylindrical surface by a variety of techniques including adhesive, crimps, mechanical clamps, or other techniques. In certain embodiments, an over-the-shaft sleeve may be secured to the outer cylindrical surface by any of the above techniques.

Arrowhead assemblies in accordance with the present disclosure have a number of advantages. For example, certain embodiments provide automatic centering of cutting blades relative to the arrow shaft. This assists in improving arrow flight by minimizing concentricity problems. Second, certain features of the present disclosure allow the arrow shaft to be incorporated as part of the arrowhead assembly to improve the strength of the assembly. Third, certain features allow a person to align the blades with their fletching by loosening the front tip and the rear compression ring, turning the collar to the aligned position, and then re-tightening the front tip and the rear compression collar. Numerous other advantages are also provided by the various features disclosed herein.

The above specification, examples and data provide a complete description of the manufacture and use of the composition of the invention. From the forgoing detailed description, it will be evident that modifications and variations can be made in the devices of the disclosure without departing from the spirit or scope of the invention. Since many embodiments of the invention can be made without departing from the spirit and scope of the invention, the invention resides in the claims hereinafter appended.

I claim:

1. An arrowhead assembly comprising:

a sleeve constructed to extend over and clamp concentrically around an arrow shaft;

an arrow point including: a tip, a shaft, the shaft having a first portion configured to be secured to an inside of the arrow shaft, and a second portion fitted to the sleeve; and a collar constructed to concentrically compress the sleeve against the arrow shaft, wherein the collar is positioned over and around the first portion of the arrow point shaft.

2. The arrowhead assembly according to claim 1, further comprising an insert configured to be fixed within an arrow shaft and configured to engage the first portion of the shaft of the arrow point.

3. The arrowhead assembly according to claim 1, further comprising a blade constructed to engage the sleeve, the blade including:

a cutting edge; and a base edge, the base edge including a rear retainer and a front retainer, wherein the front retainer is configured to be held between the arrow point and the sleeve.

4. The arrowhead assembly according to claim 3, wherein the base edge is constructed to be received in a groove on the sleeve.

5. The arrowhead assembly according to claim 4, wherein the rear retainer is configured to engage the sleeve and bias the blade radially inward when the arrow point is secured to the shaft.

6. The arrowhead assembly according to claim 1, wherein the diameter of the sleeve at an end proximate the tip of the arrow point is substantially the same as a largest diameter of the tip of the arrow point.

7. The arrowhead assembly according to claim 1, further comprising a pivot blade, the pivot blade being pivotally connected to the sleeve.

8. The arrowhead assembly according to claim 3, wherein the rear retainer is configured to be held by the collar.

9. A method of assembling an arrowhead including:

connecting an arrow tip to an inside hollow portion of an arrow shaft and compressing a shaft sleeve around the outside of the arrow shaft, wherein the step of compressing a shaft sleeve around the outside of the arrow shaft includes threading a compression collet around the shaft sleeve.

10. The method of claim 9, wherein the step of connecting an arrow tip to an inside of an arrow shaft includes threading a portion of the arrow tip to an insert secured to the hollow portion of an arrow shaft.

11. The method of claim 9, further comprising the step of positioning a plurality of blades within grooves on the shaft sleeve.

12. The method of claim 11, wherein the step of connecting the arrow tip to an inside hollow portion of an arrow shaft secures the blades to the shaft sleeve.

13. An arrowhead assembly comprising:

a plurality of blades spaced around an arrow shaft, wherein the arrowhead assembly is configured to be secured axially to the inside of an arrow shaft and radially to an outside of the arrow shaft;

an arrow tip, the arrow tip including an arrow point, the arrow point being connected to an arrow tip shaft, the arrow tip shaft having a larger diameter portion and a smaller diameter portion;

an insert, the insert being configured to be fixed within an end of the arrow shaft and connected to the larger diameter portion of the arrow tip shaft;

a sleeve, the sleeve including a first end configured to abut the arrow point and a second end that extends over the insert and the arrow shaft; and a compression collar configured to be threaded onto a second end of the sleeve to compress the sleeve onto the outside surface of the arrow shaft.

14. The arrowhead assembly according to claim 13, wherein the arrow tip is configured to be secured axially to the arrow shaft and the sleeve is configured to be secured radially to the outside surface of the arrow shaft.

15. The arrowhead assembly according to claim 14, wherein the arrow tip includes a centering portion that is configured to mate with the sleeve and the arrow tip shaft is configured to be positioned concentrically within the sleeve.

16. The arrowhead assembly according to claim 15, wherein the arrowhead assembly is constructed such that a portion of the arrow tip shaft overlaps the arrow shaft and the sleeve.

17. The arrowhead assembly according to claim 15, wherein the portion of the arrow tip shaft that overlaps the arrow shaft and the sleeve is constructed to engage an insert concentrically positioned within the arrow shaft and the sleeve.

18. An arrowhead assembly comprising:

a sleeve constructed to extend over and clamp concentrically around an arrow shaft;

an arrow point including: a tip, a shaft, the shaft having a first portion configured to be secured to an inside of the arrow shaft, and a second portion fitted to the sleeve;

a collar constructed to concentrically compress the sleeve against the arrow shaft, wherein rotation of the collar with respect to the sleeve increases the inward pressure exerted on the arrow shaft; and a pivot blade, the pivot blade being pivotally connected to the sleeve.

19. The arrowhead assembly according to claim 18, wherein the collar is positioned over and around the first portion of the arrow point shaft.

20. The arrowhead assembly according to claim 18, wherein the diameter of the sleeve at an end proximate the tip of the arrow point is substantially the same as a largest diameter of the tip of the arrow point.

21. The arrowhead assembly according to claim 18, wherein the collar is threadedly coupled to sleeve.

22. The arrowhead assembly according to claim 18, wherein rotation of the collar to increase the inward pressure exerted on the arrow shaft advances the collar toward the arrow point tip.

* * * * *